United States Patent [19]

Rolland

[11] 4,155,578

[45] May 22, 1979

[54] SAFETY LATCH FOR INWARD SWINGING DOORS

[76] Inventor: Burton A. Rolland, 4716 Springcreek Rd., Rockford, Ill. 61111

[21] Appl. No.: 837,430

[22] Filed: Sep. 28, 1977

[51] Int. Cl.[2] ..... E05C 19/18

[52] U.S. Cl. ..... 292/292

[58] Field of Search ..... 292/292, 293, 294, 295, 292/246, 254

[56] References Cited

U.S. PATENT DOCUMENTS

| | | | |
|---|---|---|---|
| 939,785 | 11/1909 | Auger | 292/292 |
| 2,019,217 | 10/1935 | Forte | 292/292 |
| 4,022,503 | 5/1977 | Bey | 292/264 |
| 4,072,333 | 2/1978 | Hutler | 292/292 |

FOREIGN PATENT DOCUMENTS

| | | | |
|---|---|---|---|
| 35249 | 3/1922 | Norway | 292/292 |

*Primary Examiner*—Richard E. Moore

*Attorney, Agent, or Firm*—Morsbach & Pillote

[57] ABSTRACT

A safety latch for inward swinging doors, including a strap having a hook at one end extending laterally from one side for engaging the keeper on the door frame and an abutment extending laterally from the other side, and a wedge member having a pair of relatively diverging edges adapted to be positioned with one diverging edge engaging the abutment on the strap and the other diverging edge engaging the inside of the door to wedge lock the door in a closed position. A flexible member is provided for connecting the strap to the handle on the door to laterally stabilize the strap.

7 Claims, 4 Drawing Figures

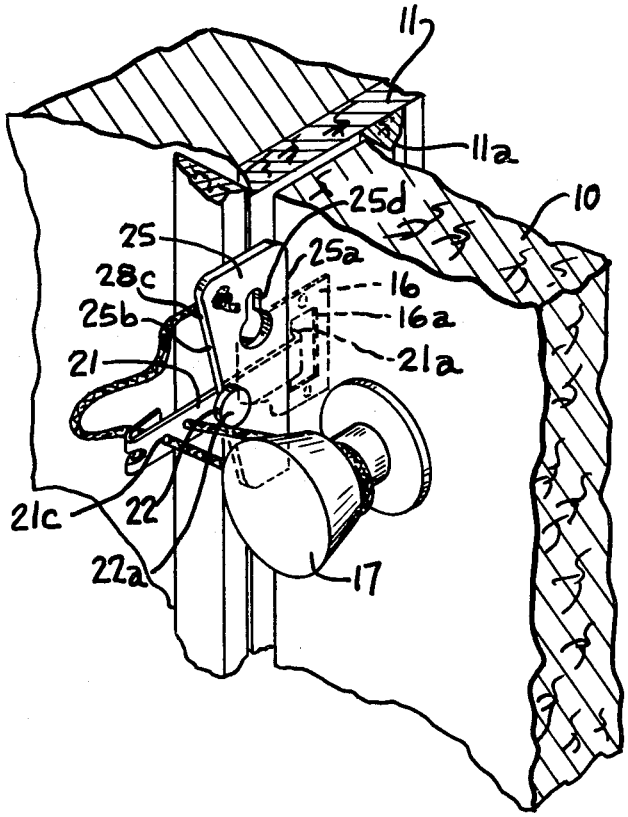

SAFETY LATCH FOR INWARD SWINGING DOORS

BACKGROUND

The safety latches that are commonly used on hingedly mounted doors to limit swinging of the door when the primary lock is opened, generally require permanent installation of parts of the safety latch on the door and door frame. Such safety latches require tools in order to mount the same on the door and door frame and leave holes and other damage marks on the door and door frame when removed. Accordingly, such safety latches are not adapted to be installed by someone only temporarily occupying the room, such as in a hotel or motel.

SUMMARY OF THE INVENTION

It is the object of the present invention to overcome the disadvantage of the prior art safety latches by providing a safety latch which can be readily installed on the door and door frame without requiring the use of tools and which can be easily removed for reuse on a different door and door frame, and which does not leave any mounting holes or damaged marks on the door and door frame when removed.

Accordingly, the present invention provides a safety latch for use on a door and frame assembly of the type in which the door is mounted for swinging inwardly to an open position and the door has a latch bolt at the free edge engageable with a keeper on the door frame and a handle at the inside of the door for operating the latch bolt, the safety latch including a strap having a hook at one end extending laterally from one side of the strap and an abutment extending laterally from the other side of the strap at a location spaced from the hook, the strap being adapted to be positioned with the hook engaging the keeper on the door frame and with the strap extending laterally of the frame at the other side, and the strap being thin to allow closing of the door while in that position whereby the door when closed holds the hook in engagement with the keeper, and a wedge member having a pair of relatively diverging edges adapted to be positioned with one diverging edge engaging the abutment on the strap and the other diverging edge engaging the other side of the door to wedge lock the door in a closed position.

A means is advantageously provided for connecting the strap to the handle on the inside of the door to laterally stabilize the strap.

These, together with other objects, features and advantages of the present invention will be more readily understood from the following description when taken in connection with the accompanying drawings wherein.

Figure 1:
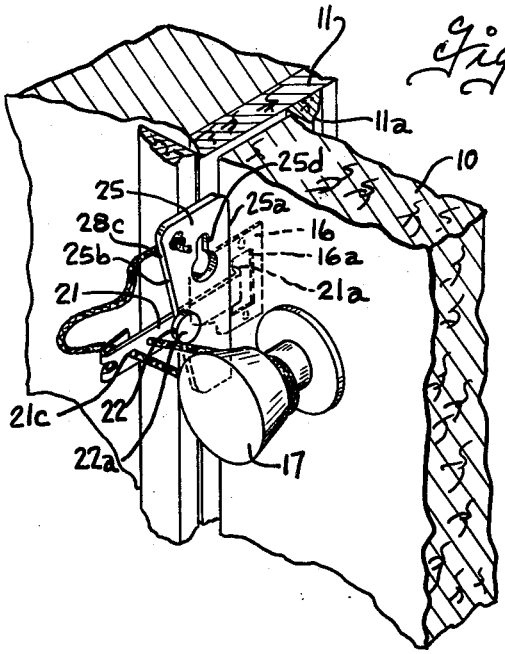
FIG. 1 is a fragmentary perspective view illustrating the safety latch installed on a door and door frame.
Figure 2:
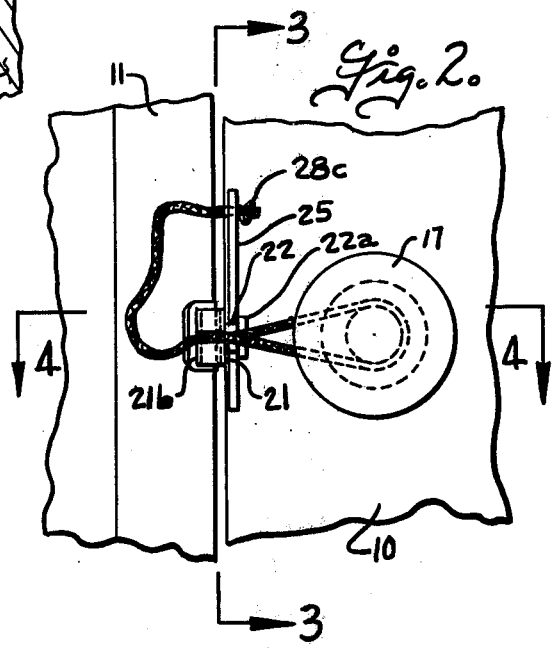
FIG. 2 is a fragmentary front elevational view showing the safety latch installed on a door and door frame.
Figure 3:
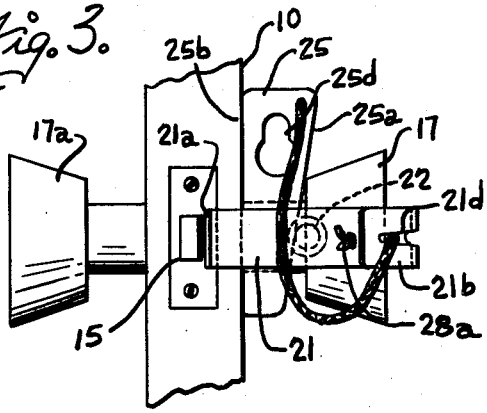
FIG. 3 is a fragmentary vertical sectional view taken on the plane 3—3 of FIG. 2.

The safety latch of the present invention is adapted for use in a door and frame assembly of the type wherein the door 10 is mounted as by hinges (not shown) on the door frame 11 for horizontal swinging movement in a direction inwardly of the room to be protected. The door in its closed position extends across the door opening defined by the door frame and engages door stop 11*a* on the door frame at the outer side of the door. The door has a latch bolt 15 at the free edge thereof which is engageable in the opening 16*a* of keeper plate 16 mounted on the door frame, and the latch bolt is commonly operated under the control of inner and outer door knobs or handles 17 and 17*a* respectively. The door 10 can be of the entrance type in which the latch bolt 15 and knobs 17 and 17*a* form part of a key operated entrance lock adapted to be selectively locked by a key (not shown) to prevent operation of the latch bolt by the outer knob 17*a*. Alternatively, the door 10 can be an inside door with the latch bolt and knobs forming a part of either a non-lockable passage set or a selectively lockable privacy passage set such as are used on bathrooms and the like.

Figure 4:
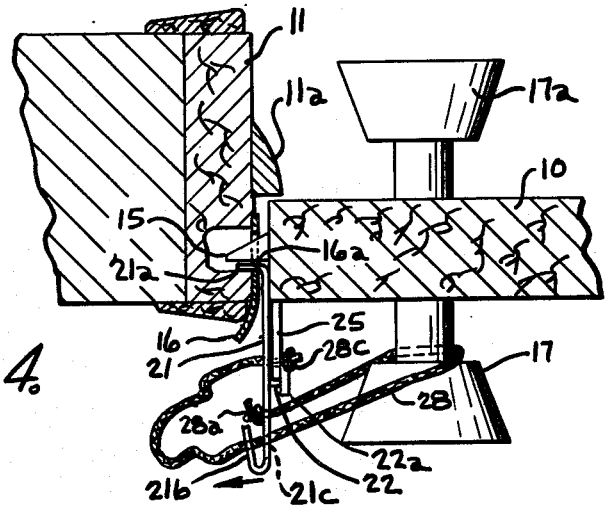
FIG. 4 is a fragmentary horizontal sectional view taken on the plane 4—4 of FIG. 2.

The safety latch includes an elongated strap 21 having a hook portion 21*a* at one end extending laterally from one side of the strap. The strap has a width less than the height of the keeper opening 16*a* in the keeper 16 and is adapted to be inserted thereinto as shown in FIGS. 1 and 4 and the strap is formed of thin, flat metal stock sufficiently thin to allow closing of the door when the hook portion is positioned in the keeper opening and the strap extends laterally from the frame at the inner side thereof, as shown in FIGS. 1 and 4. In other words, the strap is made sufficiently thin, for example about 1/16 inches or less, to lie in the normal clearance space between the free edge of the door and the door frame when the door is closed. The hook 21*a* extends laterally from the strap a distance substantially greater than the normal working clearance between the door and door frame so that when the door is closed, it holds the hook portion 21*a* on the strap in the keeper opening.

The strap 21 has an abutment 22 extending laterally from the other side thereof at a location spaced from the hook portion 21*a*. In the embodiment illustrated, the abutment 22 is in the form of a stud that is riveted, welded or otherwise rigidly secured to the strap intermediate the ends thereof and which has an enlarged head 22*a* at its outer end defining a shoulder spaced from the side of the strap. Alternatively, the abutment could be formed integrally with the strap, as by striking and bending a tab of metal from the strap.

A wedge member 25 having relatively diverging edges 25*a* and 25*b* is provided and is adapted to be inserted between the abutment 22 and the inner side of the door. As will be seen from FIG. 1, the wedge member 25 is positioned along the side of the strap opposite the side from which the hook extends with the edges 25*a* and 25*b* diverging upwardly and with one diverging edge 25*a* engaging the abutment 22 and the other diverging edge 25*b* engaging the inner side of the door adjacent its free edge. The wedge member can be pressed downwardly to tightly wedge the door in its closed position and to hold the door against inward swinging movement, even if the latch bolt is retracted from the keeper.

When the safety latch is in position as shown in FIGS. 1 and 4 and a force is applied to the door to move it inwardly, this force is transmitted through the wedge member to the abutment 22 and the major component of the force applied to the abutment is in the direction of the length of the strap member. However, since the abutment does extend laterally from the side of the strap member opposite the hook, there is a small component of this force which tends to cause shifting of the outer end portion of the strap in the direction indicated by the arrow X in FIG. 4. Accordingly, a means is provided for connecting the strap 21 adjacent its outer end to the inner door handle or knob 17, to laterally stabilize the strap. This means is conveniently in the form of a flexible member or element, such as a cord or rope 28. One end of the cord or rope is fixedly attached to the strap and, as shown, extends through an opening 29 in the strap and is knotted as indicated at 28*a*. The rope is adapted to extend around the inner handle or knob 17 and is adjustably connnected intermediate its ends to the strap. For this purpose, the outer end of the strap 21 is formed with a reverse bend to provide a portion 21*b* that overlaps one side of the strap. The strap is formed with a second opening 21*c* dimensioned to allow free lengthwise movement of the rope therethrough and the reversely bent portion 21*b* is formed with a V-shaped notch 21*d* having its minor end adjacent the opening 21*c* and its major end adjacent the outer end of the strap. The V-shaped notch is dimensioned to allow free lengthwise movement of the rope through its major end, to allow the rope to be drawn therethrough for adjusting its length, and the V-shaped notch is dimensioned to grip the rope at a location spaced from its major end to lock the rope to the strap in its lengthwise adjusted position. Thus, the rope 28 can be extended around the door knob and the end portion then pulled in a direction outwardly of the free end of the strap to tighten the rope and the rope can then be moved towards the apex of the V-notch to lock it in the adjusted position.

In order to prevent loss of parts when the safety latch is not in use, one end of the rope is conveniently attached to the wedge member 25. As shown, the other end of the rope is extended through an opening in the wedge member and knotted as indicated at 28*c*. In order to facilitate holding the wedge member and strap together in a compact package when not in use, the wedge member is herein shown formed with a key-hole shaped opening 25*d* adapted to receive the head on the abutment to hold the strap and wedge member together when the safety latch is not installed on a door and door frame.

From the foregoing it will be seen that the safety latch can be easily installed on a door and door frame without requiring tools and without requiring permanent mounting of any part of a safety latch on the door or door frame. Instead, the hook portion of the safety latch is engaged in the keeper opening on the door frame and, when the door is closed, it prevents retraction of the hook portion of the strap from the keeper opening. The wedge member 25 is inserted between the abutment on the strap and the inner side of the door to positively hold the door in its fully closed position. The flexible member is entrained around the inner door handle or knob and is adjustably secured to the strap to laterally stabilize the strap. As is readily understood, the wedge member 25 can be inserted between the abutment and door either before or after the flexible connecting member is attached to the inner door knob.

The safety latch can be used on entrance doors having key operated locks as well as on inside doors which either have no locks or a simple privacy lock. Moreover, the safety latch can be easily removed for reuse and leaves no holes or other damage marks on the door or foor frame. Further, the parts of the safety latch are compact and of relatively light weight and can be compactly stored and transported.

The embodiments of the invention in which an exclusive property or privilege is claimed are defined as follows:

1. A safety latch for use in a door and frame assembly of the type wherein the door is mounted on the frame for swinging inwardly to an open position and the door has a latch bolt at the free edge thereof engageable with a keeper on the door frame and a handle at the inside of the door for operating the latch bolt, the safety latch including a strap having a hook at one end extending laterally from one side of the strap and an abutment extending laterally from the other side of the strap at a location intermediate its ends and spaced from the hook, the strap being adapted to be positioned with the hook engaging the keeper on the door frame and with the strap extending laterally of the frame at the inner side thereof and the strap being thin to allow closing of the door while in that position whereby the door when closed holds the hook in engagement with the keeper, a wedge member having a pair of relatively diverging edges adapted to be positioned with one diverging edge engaging the abutment on the strap and the other diverging edge engaging the inner side of the door to wedge lock the door in a closed position, the forces applied by the wedge member to one abutment on the strap having a major component in a direction along the length of the strap and a second component which tends to urge the other end of the strap in a second direction laterally of said one side thereof, and connection means attached to said strap adjacent said other end and adapted for engagement with the handle at the inside of the door for connecting said other end of the strap to the handle to laterally stabilize said other end of the strap against movement in said second direction.

2. A safety latch according to claim 1 wherein said connection means includes an elongated flexible member adapted to be looped around the handle on the door, and means for adjusting the length of the connection means that is effective between the strap and the handle.

3. A safety latch according to claim 1 wherein said connection means includes a flexible member, said strap having a V-shaped opening therein dimensioned to allow free lengthwise movement of the flexible member through its major end and to grip said flexible member when the latter is shifted in the V-shaped opening to a location spaced from its major end, said flexible member having an end portion extending through said V-shaped opening.

4. A safety latch according to claim 1 wherein said connection means includes an elongated flexible member having one end secured to the strap and adapted to be looped intermediate its ends around the handle on the inside of the door to laterally stabilize the strap, and means on said strap adjacent its other end engageable with a portion of said flexible member spaced from said one end thereof for adjustably securing said flexible member to said strap.

5. A safety latch according to claim 1 wherein said connection means includes an elongated flexible member adapted to be looped around the handle on the door, said strap has spaced overlapping portions at its other end, one of said overlapping portions having a first opening dimensioned to allow free lengthwise movement of said flexible member therethrough and the other of said overlapping portions having a second V-shaped opening therein dimensioned to allow free lengthwise movement of said one end portion of the flexible member through its major end and to grip the flexible member when the latter is shifted in the V-shaped opening to a location spaced from its major end, said one end portion of said flexible member extending through said first and second openings.

6. A safety latch according to claim 5 wherein the minor end of the V-shaped opening is disposed adjacent said opening in the strap.

7. A safety latch according to claim 5 wherein the terminus of said one end portion of said flexible member is attached to said wedge member to loosely interconnect said wedge member and the strap.

* * * * *